US012622527B2

(12) United States Patent
Li et al.

(10) Patent No.: US 12,622,527 B2
(45) Date of Patent: May 12, 2026

(54) SOFA UNFOLDING DEVICE

(71) Applicant: JASON FURNITURE (HANGZHOU) CO., LTD., Hangzhou (CN)

(72) Inventors: Yunhai Li, Hangzhou (CN); Yuanfeng Feng, Hangzhou (CN); Linlin Wu, Hangzhou (CN); Zhiyu Wang, Hangzhou (CN); Liang Cui, Hangzhou (CN)

(73) Assignee: JASON FURNITURE (HANGZHOU) CO., LTD., Hangzhou (CN)

( * ) Notice: Subject to any disclaimer, the term of this patent is extended or adjusted under 35 U.S.C. 154(b) by 487 days.

(21) Appl. No.: 18/205,610

(22) Filed: Jun. 5, 2023

(65) Prior Publication Data

US 2024/0164532 A1 May 23, 2024

Related U.S. Application Data

(63) Continuation-in-part of application No. 17/991,874, filed on Nov. 22, 2022, now abandoned.

(51) Int. Cl.
*A47C 1/034* (2006.01)
*A47C 1/035* (2006.01)
(Continued)

(52) U.S. Cl.
CPC ..... *A47C 17/163* (2013.01); *A47C 1/034* (2013.01); *A47C 1/0342* (2013.01); *A47C 1/035* (2013.01);
(Continued)

(58) Field of Classification Search
CPC ..... A47C 17/162; A47C 17/163; A47C 17/86; A47C 17/1756; A47C 17/1753;
(Continued)

(56) References Cited

U.S. PATENT DOCUMENTS 959,949 A 5/1910 Leipert
4,000,529 A 1/1977 De Maria
(Continued)

FOREIGN PATENT DOCUMENTS

CN 209644426 U 11/2019
CN 213308543 U 6/2021
(Continued)

OTHER PUBLICATIONS

United States Patent and Trademark Office; U.S. Office Action related to Corresponding U.S. Appl. No. 17/991,874; Mar. 6, 2023; 11 Pgs.

*Primary Examiner* — Robert Canfield
(74) *Attorney, Agent, or Firm* — Cooper Legal Group, LLC

(57) ABSTRACT

The present application relates to a sofa unfolding device capable of avoiding forward overturning, including a seat, a backrest assembly, a linkage assembly, and a leg rest assembly, wherein the linkage assembly is rotatably connected on the seat, the backrest assembly is rotatably connected to a rear end of the seat via the linkage assembly, the leg rest assembly is rotatably connected to a front end of the seat via the linkage assembly, a support mechanism is connected on the front end of the seat and comprises an abutting member and a support member, the abutting member is rotatably connected with the linkage assembly via a first pivot, and the support member is rotatably connected with the abutting assembly via a second pivot and is rotatably connected with the seat via a third pivot.

19 Claims, 10 Drawing Sheets

(51) Int. Cl.

| | |
|---|---|
| ***A47C 1/0355*** | (2013.01) |
| ***A47C 7/50*** | (2006.01) |
| ***A47C 17/16*** | (2006.01) |
| ***A47C 17/175*** | (2006.01) |
| ***A47C 17/86*** | (2006.01) |

(52) U.S. Cl.
CPC ..... *A47C 7/5068* (2018.08); *A47C 17/162* (2013.01); *A47C 17/1753* (2013.01); *A47C 17/1756* (2013.01); *A47C 17/86* (2013.01)

(58) Field of Classification Search
CPC ..... A47C 1/0355; A47C 1/0352; A47C 1/034; A47C 1/035; A47C 1/0342
USPC ..... 297/423.21, 354.12, 354.13
See application file for complete search history.

(56) References Cited

U.S. PATENT DOCUMENTS

| | | | | |
|---|---|---|---|---|
| 4,319,780 | A | 3/1982 | Rogers, Jr. | |
| 5,104,181 | A | 4/1992 | Lange | |
| 5,931,535 | A | 8/1999 | Sweet | |
| 6,354,657 | B1 | 3/2002 | Nelson et al. | |
| 2007/0252422 | A1* | 11/2007 | Beaver ..... | A47C 7/506 297/423.24 |
| 2022/0338634 | A1* | 10/2022 | Jakubowski ..... | A47C 1/0355 |

FOREIGN PATENT DOCUMENTS

| | | | |
|---|---|---|---|
| CN | 214548421 | U | 11/2021 |
| CN | 113842000 | A | 12/2021 |

* cited by examiner

SOFA UNFOLDING DEVICE

CROSS-REFERENCE TO RELATED APPLICATION

This application is a Continuation-In-Part of U.S. patent application Ser. No. 17/991,874, filed on Nov. 22, 2022. The entirety of U.S. patent application Ser. No. 17/991,874 is hereby incorporated by reference herein and made a part of this specification.

FIELD OF THE INVENTION

The present application relates to the field of a sofa or a chair, especially to a functional sofa or chair, and in particular to a sofa unfolding device capable of avoiding forward overturning.

DESCRIPTION OF RELATED ART

In recent years, functional sofas have become more and more popular in the market. The functional sofa refers to an foldable or multi-functional sofa that may be switched among states for sitting, half-lying, and lying by means of an internal foldable iron frame. The iron frames of such sofa are classified as two types: an armrest floor-standing type and an iron frame floor-standing type, each of which has its own advantages in terms of footprint and comfort. The iron frame floor-standing sofa is found to have a hidden danger of overturning forward as a whole during use. The reason for this hidden danger lies in that, there is insufficient contact area between the iron-frame floor-standing sofa and the ground. Therefore, when the user does some actions, the sofa tends to lose its center of gravity during the process of switching the states of the sofa, especially after being switched to a sitting or lying state, and in turn overturns forward as a whole.

In order to eliminate the above-mentioned hidden dangers, China Utility Model No. CN209644426U discloses a support structure rotating outwards and touching the ground with the movement of a sofa iron frame. When unfolding the iron frame, this support structure rotates out of the sofa iron frame, and finally presses against the ground, so as to provide an additional support structure for the sofa iron frame. However, this utility model suffers from an apparent defect. That is, when the support structure, which itself is a rigid part, is rotated directly out of the sofa ion frame, if there is a foreign object just positioned at a position where the support structure touches the ground, the support structure in this utility model will not only fail to provide additional support force for the sofa iron frame, but also tend to tilt or lose the center of gravity of the sofa iron frame.

BRIEF SUMMARY OF THE INVENTION

In view of the problem of losing it center of gravity or instability of an iron sofa frame during unfolding, the present application provide a safe unfolding device that is capable of avoiding forward overturning.

In a first aspect, the present application provides a sofa unfolding device capable of avoiding forward overturning, including a backrest assembly, a linkage assembly, and a seat, in which the linkage assembly is provided on the seat; the backrest assembly is rotatably connected with the linkage assembly, a support mechanism is provided at a front end of the linkage assembly, the support mechanism includes an abutting member and a support assembly, is configured to stretch simultaneously forward and downward with unfolding of the linkage assembly and abut against a ground to act as a support structure. The support mechanism includes an abutting member and a support assembly; the abutting member is rotatably connected with the linkage assembly via a first pivot; the support assembly is rotatably connected with the abutting member via a second pivot; and the support assembly is rotatably connected with the seat via a third pivot; and the abutting member is configured to stretch simultaneously forward and downward with unfolding of the linkage assembly and abut against a ground. In particular, the first pivot and the second pivot are configured to be kept at an upper half of the linkage assembly.

In some embodiments, a bottom of the abutting member is at a first position when the linkage assembly is in a folded state; the abutting member is at a second position when the linkage assembly is in an unfolded state; and a horizontal distance between the first position and the second position is greater than 100 mm.

In some embodiments, the abutting member is rotatably connected at a top thereof with the linkage assembly via the first pivot; a bottom of the abutting member is configured to be a free end and connected with a roller; and the roller is configured to be located above the seat when the linkage assembly is folded and located in front of the seat when the linkage assembly is unfolded. The support assembly includes a support rod body; the support rod body is rotatably connected at a first end thereof with the abutting member via the second pivot; and rotatably connected at a second end thereof with the seat via the third pivot.

In some embodiments, the first pivot is configured to be kept above the second pivot.

In some embodiments, the described sofa unfolding device further includes a leg rest assembly; wherein the leg rest assembly is connected with the linkage assembly and configured to be unfolded with unfolding of the linkage assembly; and the leg rest assembly is configured to be located above the abutting member of the support mechanism when the linkage assembly is unfolded; a linkage rod is provided between the leg rest assembly and the linkage assembly; the seat includes a fixed member, and a first follower and a second follower provided at both ends of the fixed member, respectively; the first follower and the second follower are rotatably connected with the linkage assembly; the linkage rod is rotatably connected at a first end thereof with the first follower via a fourth pivot, and rotatably connected at a second end thereof with the linkage assembly; and both of the first pivot and the second pivot are configured to be kept above the fourth pivot.

In some embodiments, the support assembly includes a limiting rod, a push rod, and a connecting rod; the push rod is rotatably connected at a first end thereof with the first follower, and rotatably connected at a second end thereof with a first end of the connecting rod; the connecting rod is rotatably connected at a second end thereof with the abutting member via the second pivot; the limiting rod is rotatably connected at a first end thereof with the fixed member via the third pivot; and the limiting rod is rotatably connected at a second end thereof with the push rod. A connection pivot between the limiting rod and the push rod is located between the first end of the push rod and the second end of the push rod.

In some embodiments, a second support assembly is provided on the seat and configured to slide back and forth along the seat from a rear end of the seat to a front end of the seat, a linkage member is rotatably connected on the second support assembly via a fifth pivot and is rotatably connected with the support assembly via a sixth pivot, the second support assembly is configured to be driven by the linkage member to slide forward when the linkage assembly is unfolded, and the second support assembly comprises a support part located at a front end of the seat.

In some embodiments, the seat comprises a front part and a side part connected with each other, the second support assembly further comprises a slide part connected with the support part, and the slide part is slidingly connected with the front part and the side part, respectively.

In some embodiments, a slide rail is connected on the side part, a first slide block in cooperation with the slide rail is provided on the slide part, and a second slide block in slide cooperation with the slide part is provided on the front part.

In some embodiments, a slide joint between the front part and the slide part is located above the slide part.

In some embodiments, the support part includes a support wheel.

In a second aspect, the present application provides a sofa unfolding device, including a seat, a backrest assembly, a linkage assembly, and a leg rest assembly, wherein the linkage assembly is rotatably connected on the seat, the backrest assembly is rotatably connected to a rear end of the seat via the linkage assembly, the leg rest assembly is rotatably connected to a front end of the seat via the linkage assembly, a support mechanism is connected on the front end of the seat and comprises an abutting member and a support member, the abutting member is rotatably connected with the linkage assembly via a first pivot, the support member is rotatably connected with the abutting assembly via a second pivot and is rotatably connected with the seat via a third pivot, and the abutting member is configured to stretch simultaneously toward a front and a bottom of the seat with the unfolding of the linkage assembly and abut against a ground.

In the above technical solution, when the sofa is unfolded from a fold state to a fully unfold state, the linkage assembly is unfolded gradually, the leg rest assembly stretches gradually toward a front of the sofa, while the abutting member stretches simultaneously toward a front and a bottom of the seat with the unfolding of the linkage assembly until abutting against the ground. The abutting member enables an auxiliary support after the sofa is unfolded, preventing overturning of the sofa. Meanwhile, when being changed from a fold state to an unfold state, the abutting member exerts a forward pushing force, so as to push away a foreign object, if any, in front of the sofa, so that the abutting member can touch the ground, avoiding overturning of the sofa due to pressing the foreign object under the abutting member, while avoiding occurrence of damaging or breaking the foreign object.

In some embodiments, the linkage assembly includes a connecting rod assembly, a first follower and a second follower, the first follower is rotatably connected to the front end of the seat, the second follower is rotatably connected to the rear end of the seat, the connecting rod assembly is rotatably connected with the first follower and the second follower, respectively, the backrest assembly and the leg rest assembly are rotatably connected with the connecting rod assembly, the first follower is configured to be rotated toward the front end of the seat with the unfolding of the connecting rod assembly, the abutting member is rotatably connected with the first follower via the first pivot, and the abutting member is configured to stretch simultaneously toward the front and the bottom of the seat with a rotation of the first follower and abut against a ground.

In the above technical solution, the seat, the first follower, the abutting member, and the support assembly form a quadrilateral frame by hinging connection. When the first follower is rotated with the unfolding of the sofa, the interior angles of the quadrilateral frame are changed, and four sides are rotated. During this process, the abutting member will be gradually rotated with the rotation of the first follower, so that a free end of the abutting member gradually stretch toward a front of the sofa. Meanwhile, due to an arc movement of the abutting member driven by the rotation of the first follower, the abutting member will be gradually moved toward a bottom of the sofa, whereby the abutting member gradually stretch to touch the ground, providing an auxiliary support to the sofa.

In some embodiments, the abutting member is provided with a rolling wheel configured to abut against the ground, the rolling wheel is configured to be located above the seat when the linkage assembly is folded, and to be located in front of the seat when the linkage assembly is unfolded, and the fifth pivot and the sixth pivot are kept above the rolling wheel.

In the above technical solution, the rolling wheel can reduce a friction force between the ground and the abutting member when the abutting member touches the ground. Keeping the first pivot and the second pivot above the rolling wheel can guarantee a bottom-to-up movement of the abutting member relative to the support assembly when the abutting member stretches, so as to push away any foreign object present in front of the sofa, thereby increasing a stability for unfolding the sofa.

In some embodiments, the first pivot is located above the second pivot.

In the above technical solution, the rolling wheel can be unfold to a place above the seat, so that the linkage assembly will not protrude after unfolding the rolling wheel, providing a more compact sofa structure.

In some embodiments, a second support assembly is provided on the seat and configured to slide back and forth along the seat from a rear end of the seat to a front end of the seat, a linkage member is rotatably connected on the second support assembly via a fifth pivot and is rotatably connected with the support assembly via a sixth pivot, the second support assembly is configured to be driven by the linkage member to slide forward when the linkage assembly is unfolded, and the second support assembly comprises a support part located at the front end of the seat.

In the above technical solution, providing the second support assembly enables a constant auxiliary support to the sofa during unfolding. The portion for auxiliary support moves forward with the unfolding of the sofa, so as to meet requirements of safety and use in a limited space, while avoiding stretching of a support part to a relatively far position from the seat even if the sofa has not been fully unfold, which renders the sofa more compact during use.

In some embodiments, the seat includes a front part and a side part connected with each other, the second support assembly further comprises a slide part connected with the support part, and the slide part is slidingly connected with the front part and the side part, respectively.

In the above technical solution, connecting the slide part to the front part and side part respectively enables a more robust connection between the second support assembly and the seat, avoiding a deformation of the seat due to excessive stress.

In some embodiments, a slide rail is connected on the side part, a first slide block in cooperation with the slide rail is provided on the slide part, and a second slide block in slide cooperation with the slide part is provided on the front part.

By adopting the above technical solution, a conventional sofa can be upgraded to a sofa having continuous support, merely by adding an additional connection slide rail at the side part, while providing a second slide block at the front part and adding an linkage member. It merely requires simple mounting.

In some embodiments, a slide joint between the front part and the slide part is located above the slide part.

In the above technical solution, since the slide part receives an up-to-down force during use and the front part is located above the slide part, there will be more close contact between the slide part and the front part after slide part is pressed, so as to avoid a disengagement between the two parts, providing a safer unfolding.

In some embodiments, the support part includes a support wheel.

The above technical solution reduces a friction between the second support assembly and the ground during sliding, decreasing wear and tear to the ground or the sofa during use.

In summary, the present applicant can achieve at least one of the following beneficial effects.

1. The support mechanism can stretch with the unfolding of the sofa, and moves toward the front and the bottom of the sofa during stretching, until touching the ground, which can push away a foreign object present in front of the sofa and avoid overturning of the sofa due to pressing the foreign object under the abutting member.

2. Providing the second support assembly enables a constant auxiliary support to the sofa during unfolding. The position for auxiliary support moves forward with the unfolding of the sofa, so as to meet requirements of safety and use in a limited space, while pushing away the foreign objection present in front of the sofa by the second support assembly, so that the sofa can be unfold more safely.

DETAILED DESCRIPTION

The present application will be further described in detail by reference to particular embodiments below.

Embodiment 1

Figure 1:
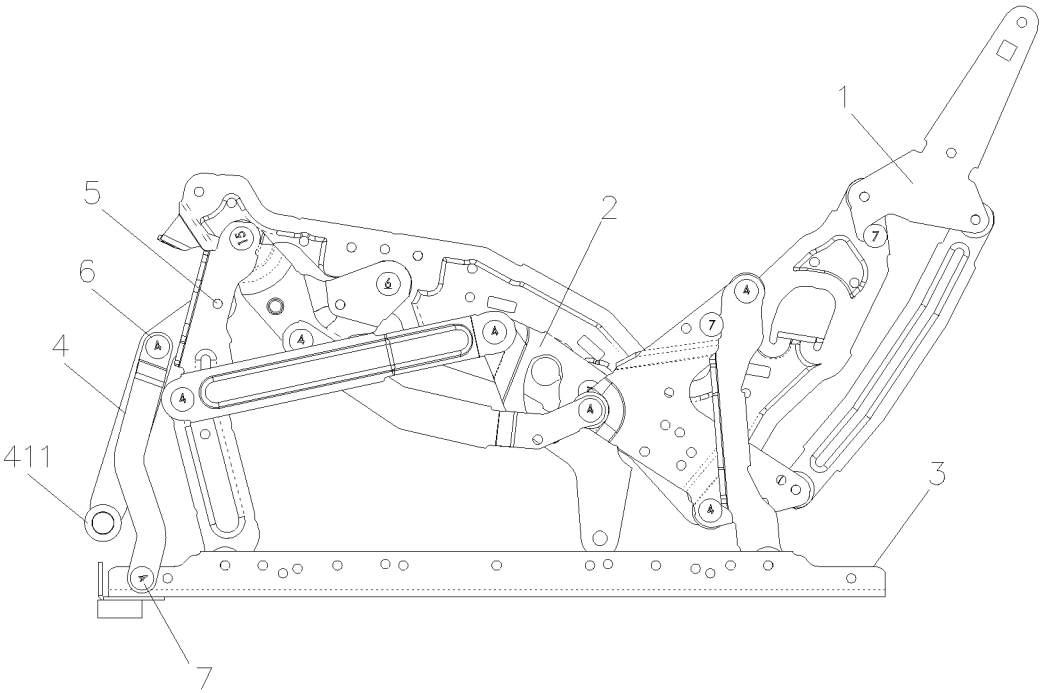
FIG. 1 is a schematic view of Embodiment 1 in a folded state.

As shown in FIG. 1, a sofa unfolding device includes a backrest assembly 1, a linkage assembly 2, and a seat 3, in which the linkage assembly 2 is rotatably connected with the seat 3; the backrest assembly 1 is rotatably connected with the linkage assembly 2; and a support mechanism 4 is provided at a front end of the linkage assembly 2. In the sofa unfolding device, the linkage assembly 2 is configured to function as a linkage center for the whole sofa unfolding device, while serving as a device for installing a cushion thereon. The backrest assembly 1 is configured to install the sofa backrest thereon. Therefore, the sofa unfolding device of the present application is particularly suitable for being used as a skeleton of a functional sofa.

Figure 2:
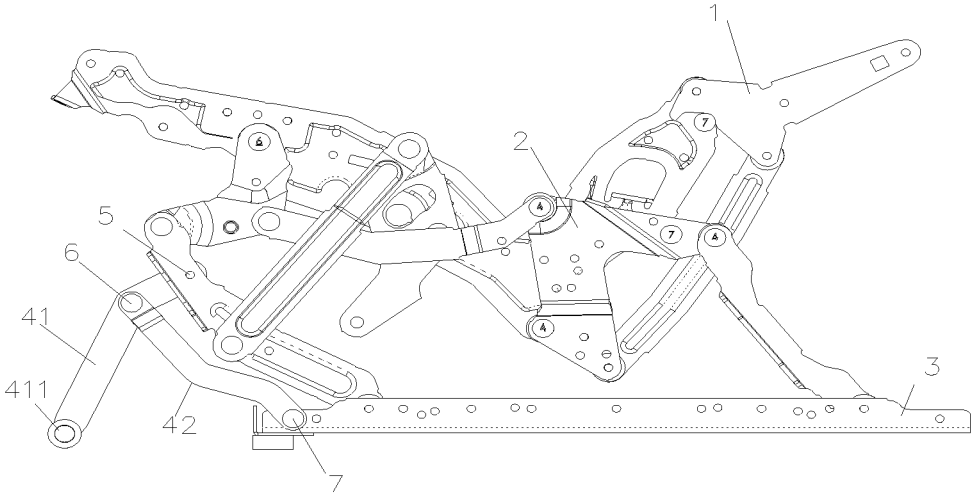
FIG. 2 is a schematic view of Embodiment 1 in an unfolded state.

As shown in FIG. 2, the linkage assembly 2 is a linkage mechanism including a plurality of rods. When the linkage assembly 2 receives a forward pushing force, it drives the backrest assembly 1 to translate along the seat 3 to realize a forward movement of the linkage assembly 2 and synchronous backward tilting of the backrest assembly 1. In this way, a sofa unfolding device with a near-lying function is provided, which improves the comfort of the sofa unfolding device.

In the above structure, the seat 3 is fixed. Therefore, when the linkage assembly 2 is moved forward and drives the backrest assembly 1 to tilt backward, an initial supporting area of the seat 3 may be insufficient for a stable support.

To this end, a support mechanism 4 linked with the linkage assembly 2 is added at a side of the seat 3. The support mechanism 4 includes an abutting member 41 and a support assembly 42. The top of the abutting member 41 is rotatably connected with the linkage assembly 2 via a first pivot 5; the support assembly 42 is rotatably connected with the abutting member 41 via a second pivot 6; the support assembly 42 is rotatably connected with the seat 3 via a third pivot 7; and each of the components of the support mechanism 4 acts synchronously with unfolding of the linkage assembly 2. In this way, the support mechanism 4 is fully unfolded when the linkage assembly 2 is fully folded. In particular, the support mechanism 4 enables the abutting member 41 to step forward from the first position in the folded state and gradually move downward and finally touches the ground, through the forward pushing action from the first pivot 5, the second pivot 6, and the linkage assembly 2, so as to provide an auxiliary support for the sofa unfolding device in the unfolded state, so that the sofa unfolding device remains stable even in the fully unfolded state.

Since the abutting member 41 will press against the ground, a roller 411 is provided at the bottom of the abutting member 41, so that the abutting member 41 presses against the ground through the roller 411, thereby avoiding damages of the abutting member 41 and the ground due to pressure, which can protect the ground and the abutting member 41 itself from being damaged by pressure.

Figure 3:
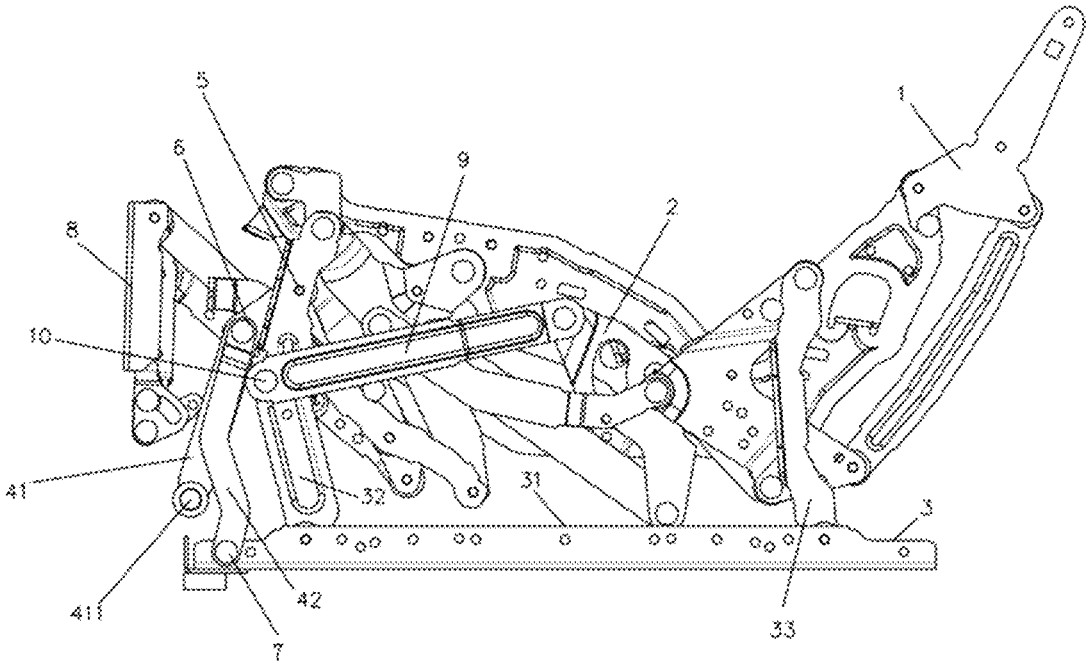
FIG. 3 is a schematic view of Embodiment 1 with an additional leg rest assembly in a folded state.
Figure 4:
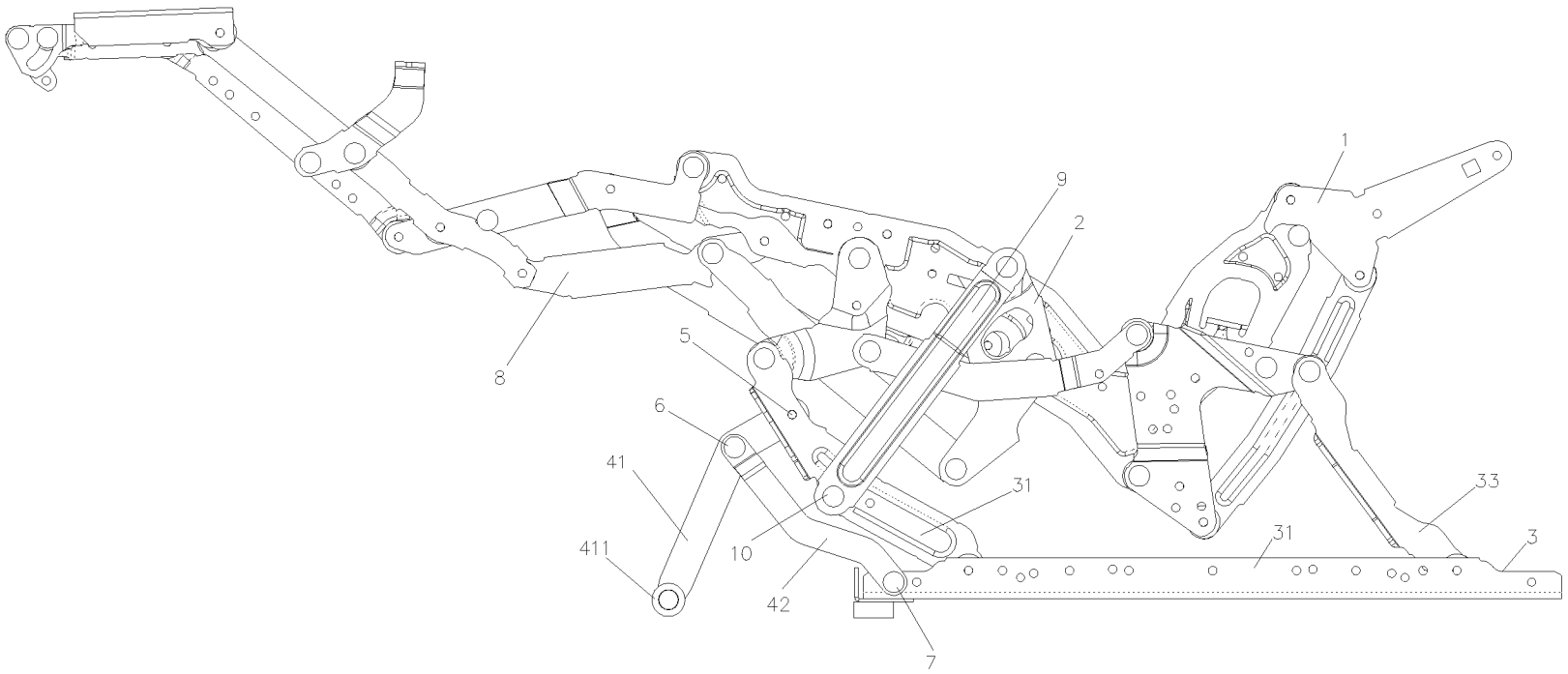
FIG. 4 is a schematic view of Embodiment 1 with an additional leg rest assembly in an unfolded state.

As shown in FIG. 3 and FIG. 4, a leg rest assembly 8 may also be added to the sofa unfolding device. The leg rest assembly 8 is configured to provide support for the user's legs when the linkage assembly 2 is in an unfolded state. The leg rest assembly 8 is connected with the linkage assembly 2 and is extended synchronously with unfolding of the linkage assembly 2. The leg rest assembly 8 is fully extended when the linkage assembly 2 is unfolded. At this time, the leg rest assembly 8 is located above the abutting member 41. In this way, the sofa unfolding device synchronizes the extending direction and extending action of the linkage assembly 2, the leg rest assembly 8, and the support mechanism 4, so that the support mechanism 4 is extended synchronously with unfolding of the linkage assembly 2 and the leg rest assembly 8, and further provides an auxiliary support for the whole sofa unfolding device.

In the above structure, it is necessary to make the abutting member 41 move forward as much as possible in the unfolded state in order to provide as more reliable auxiliary support as possible without affecting the structural rationality of the sofa unfolding device. Therefore, the pivot of the support mechanism 4 needs to be scientifically designed.

For this purpose, in this embodiment, there are common parts and pivots between the linkage assembly 2 and the seat 3, including the linkage rod 9, the first follower 32, and the second follower 33. The first follower 32 and the second follower 33 are rotatably connected with the linkage rod 9 and other rods constituting the linkage assembly 2, so that the linkage assembly 2 is rotatably connected with the seat 3. The leg rest assembly 8 is rotatably connected with the linkage assembly 2 by the linkage rod 9. The seat 3 includes a fixed member 31 rotatably connected with the first follower 32 and the second follower 33; and the fixed member 31 is configured to support the whole sofa unfolding device and is placed on the ground. The linkage rod 9 is rotatably connected at a first end thereof with the first follower 32 via a fourth pivot 10; and rotatably connected at a second end thereof with other rod that constitutes the linkage assembly 2. In this way, the leg rest assembly 8 is driven by the linkage rod 9 to move with the linkage assembly 2. During this process, the first pivot 5 and the second pivot 6 between the support mechanism 4 and the linkage assembly 2 are designed to be kept above the fourth pivot 10. The lengths of the abutting member 41 and the support assembly 42 are increased, and the forward movement distance of the abutting member 41 after extension is maintained at 100 mm-150 mm, by arranging the pivot between the support mechanism and 4 and the linkage assembly 2 above the pivot between the linkage assembly 2 and the leg rest assembly 8. In the above embodiment, the rotatable support mechanism 4 enables the abutting member 41 to realize the folding function, so as to ensure that the support mechanism 4 will not protrude when the sofa unfolding device is in the retracted state. However, the shape of the abutting member 41 may also be changed to make the support mechanism 4 smaller in a retracted state. In this embodiment, for this purpose, the abutting member 41 is configured to be a downward bent shape, so that the roller 411 is located above the seat 3 when the linkage assembly 2 is folded in place, and the roller 411 is located in front of the seat 3 when the linkage assembly 2 is unfolded.

Embodiment 2

Embodiment 2 is an improvement based on Embodiment 1, and has a structure that is substantially the same as that of Embodiment 1, except for changing the support rod to a support assembly 42.

Figure 5:
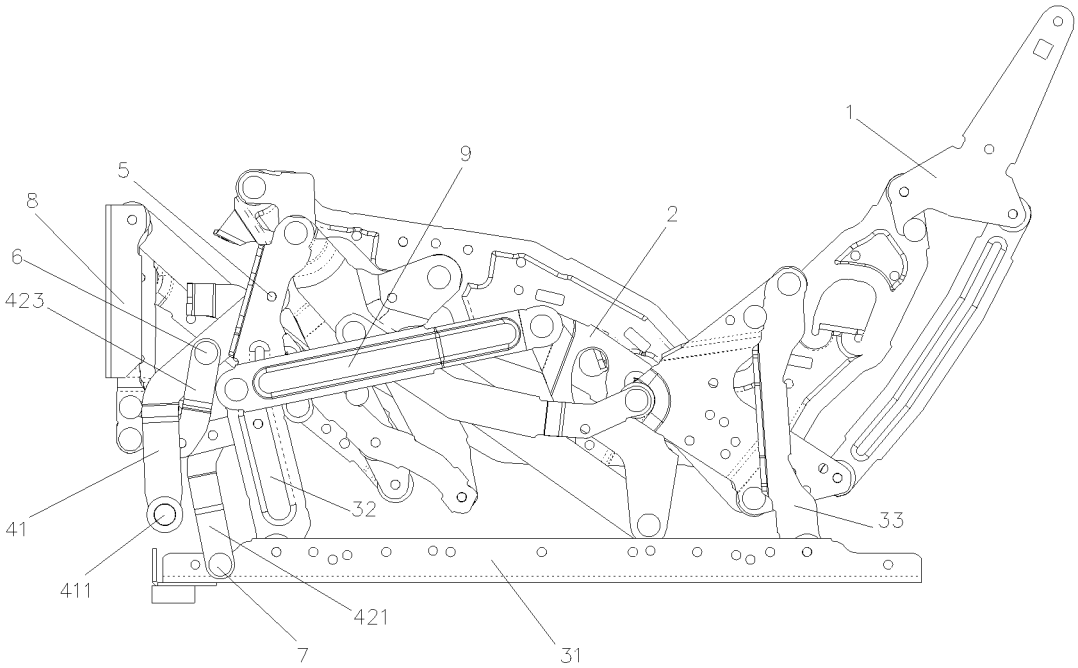
FIG. 5 is a schematic view of Embodiment 2 in a folded state.
Figure 6:
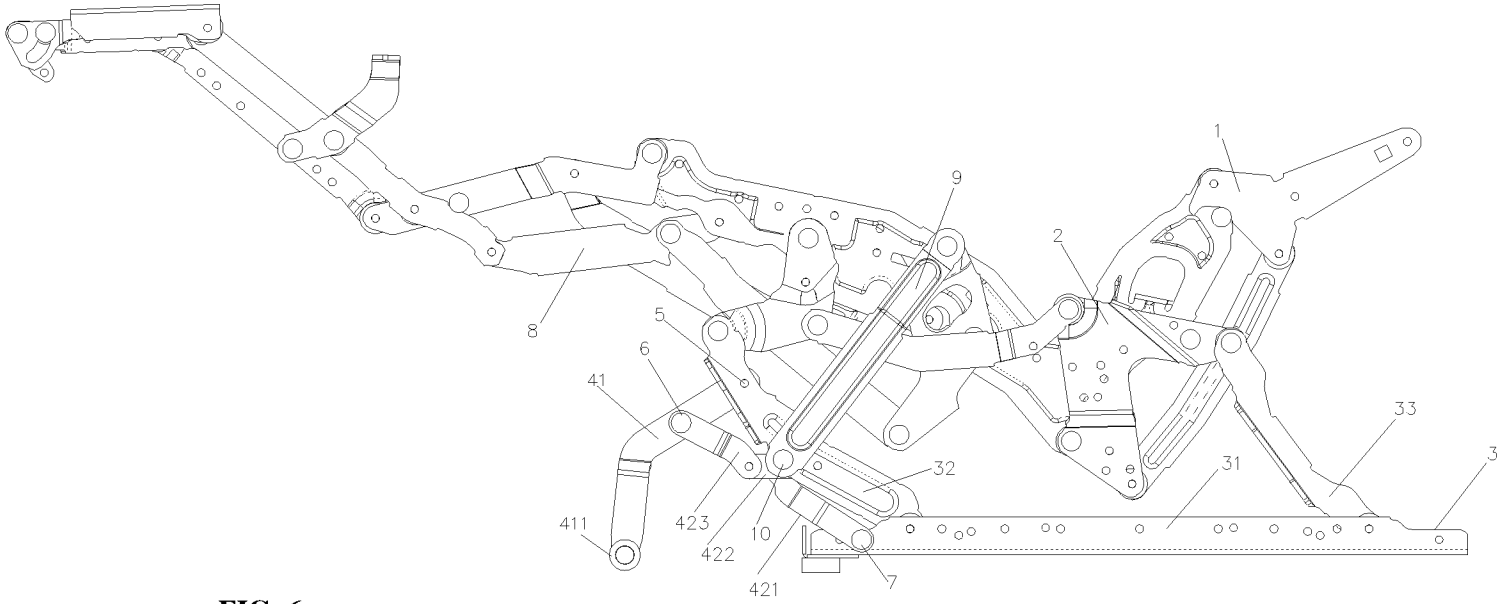
FIG. 6 is a schematic view of Embodiment 2 in an unfolded state.
Figure 7A:
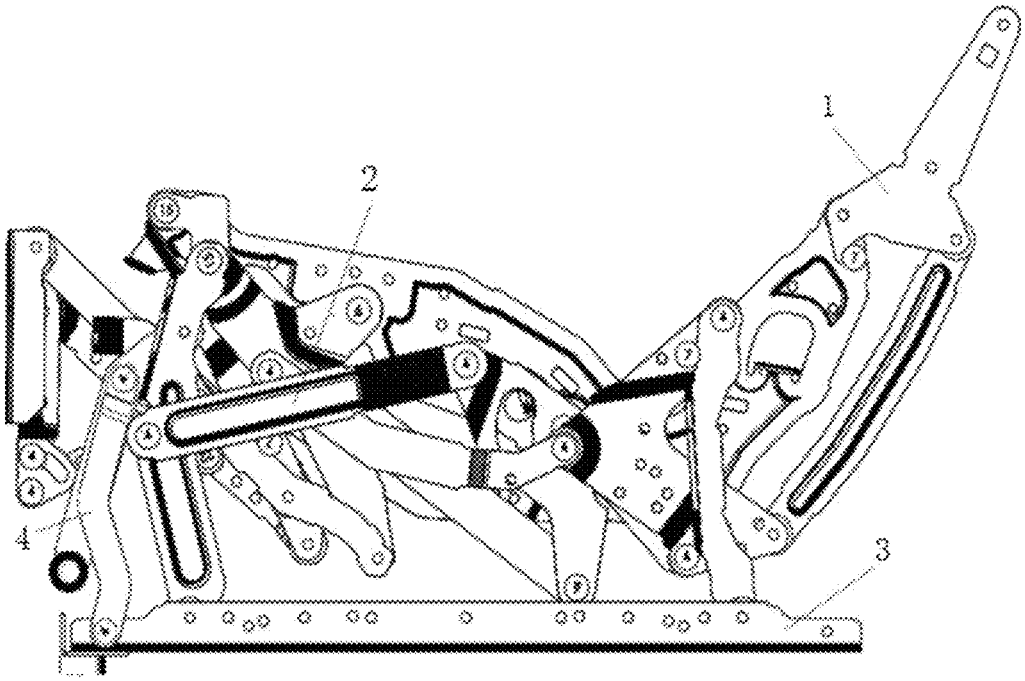
FIGS. 7A-7D are schematic views illustrating unfolding process of Embodiment 1 with a leg rest assembly.
Figure 7B:
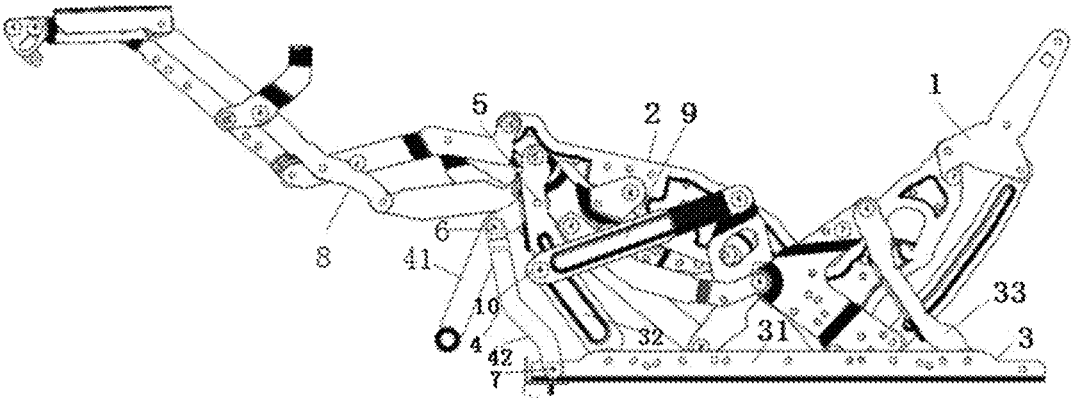
Figure 7C:
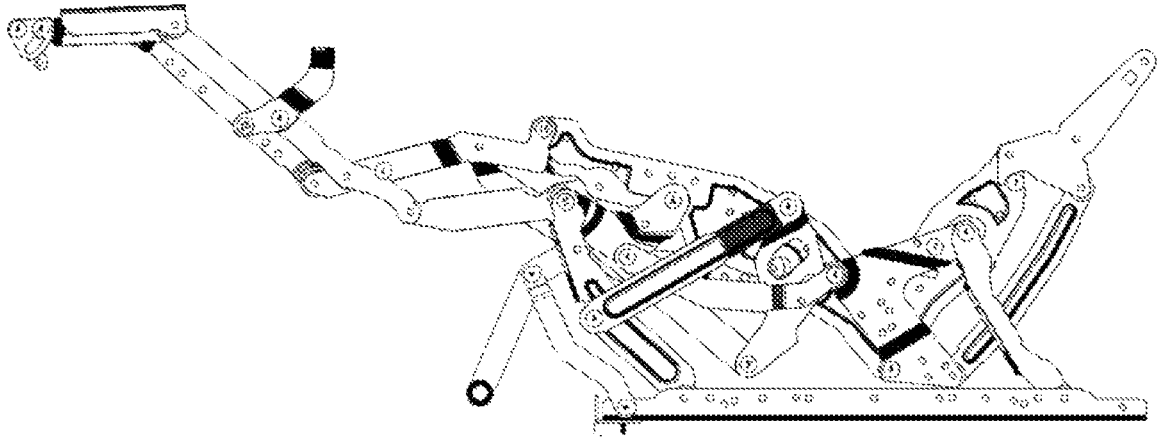
Figure 7D:
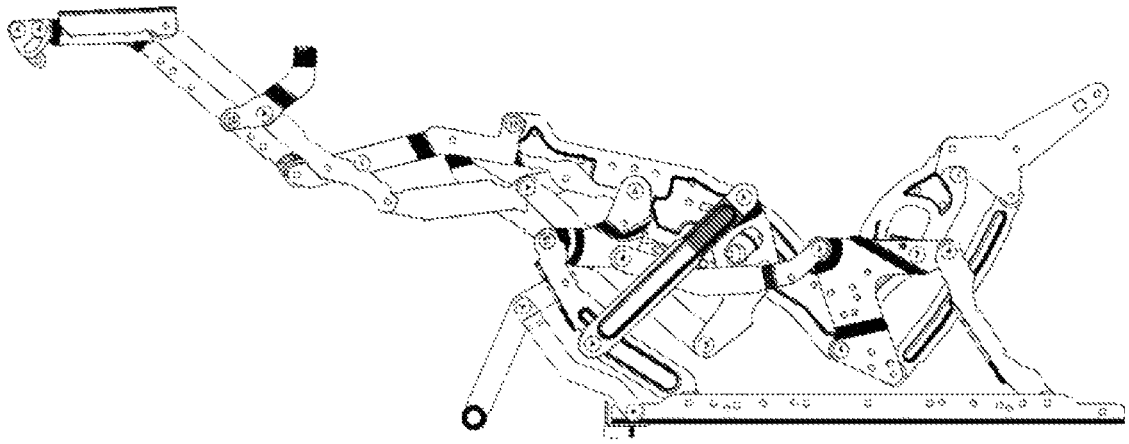

As shown in FIGS. 5 and 6, the support assembly 42 includes a limiting rod 421, a push rod 422, and a connecting rod 423; the push rod 422 is rotatably connected at a first end thereof with the first follower 32; and rotatably connected at a second end thereof with the connecting rod at a first end thereof; the connecting rod 423 is rotatably connected at a second end thereof with the abutting member 41 via the second pivot 6; the limiting rod 421 is rotatably connected at a first end thereof with the fixed member 31 via the third pivot 7; the limiting rod 421 is rotatably connected at a second end thereof with the push rod 422; a connection pivot between the limiting rod 421 and the push rod 422 is located between the first end of the push rod 422 and the second end of the push rod 422.

In Embodiment 2, the structure of the support assembly 42 is changed, but the folding function of the support assembly 42 is also realized, while ensuring that the support mechanism 4 will not protrude when the sofa unfolding device is in the retracted state. Further, the support assembly 42 is modified to be a structure in which a plurality of rods are linked with each other, such that the modified support mechanism 4 may act more compactly and timely, meanwhile the problem of forming gas caused by long-term use and multiple extensions and contractions of the support mechanism 4 will be avoided.

As can be seen from the above two embodiments that the sofa unfolding device provided by the present application is a sofa unfolding device with the functions of the seat cushion moving forward and the backrest lying down synchronously. Compared with the traditional sofa unfolding device, it provides more comfort. At the same time, the sofa unfolding device provided by the present application also has expansibility. For example, a leg rest assembly may be added to the sofa unfolding device as required, so that the sofa unfolding device also has the advantage of multiple functions. Seated on this, the sofa unfolding device provided in the present application obtains better auxiliary support and improved safety by means of a support mechanism with a larger forward movement distance.

The support mechanism provided by the present application also has advantages compared with similar products.

As shown in FIGS. 7A-7D, the support mechanism provided by the present application moves forward from the folded state and gradually extends and moves forward for a certain distance as the sofa iron frame converts from the folded state to the unfolded state. Then, with further extension of the sofa iron frame, the support mechanism extends downward while moving forward. Finally, the support mechanism is fully extended and presses against the ground by the rubber rollers at the end of the abutting member when the sofa iron frame completes the extension action. Different from the support structure in similar products, which is a rotating and protruded structure, the support mechanism provided by the present application performs a forward movement at the initial stage of extension, so that foreign objects in front of the support mechanism may be removed by the abutting member, thereby avoiding hindering the final locating point of the support mechanism by foreign objects.

Meanwhile, the structure of the support mechanism provided by the present application is relatively simple; and the purpose of preventing the sofa unfolding device from turning forward may be achieved by only two rods rotatably connected with each other and connected with the sofa unfolding device. At the same time, the support mechanism may also be disassembled according to the specific structure of the sofa unfolding device, so that a safe support mechanism for preventing the sofa unfolding device from turning forward may be assembled by three or even more rods rotatably connected and connected with the sofa unfolding device.

To sum up, the present application provides a safe, reliable and effective support mechanism for preventing the sofa unfolding device from overturning forward. At the same time, the present application further provides a sofa unfolding device with the safe support mechanism and the functions of forward movement of the seat cushion and backward tilt of the backrest.

Embodiment 3

Figure 8:
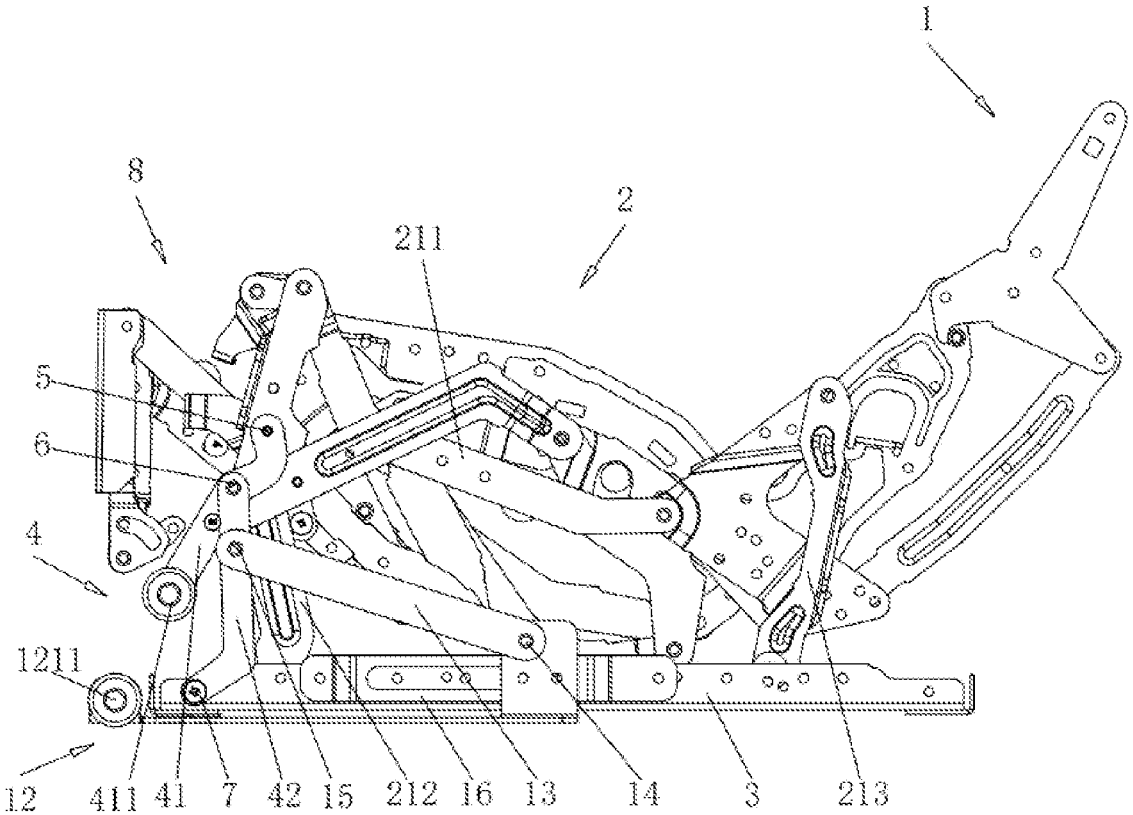
FIG. 8 is a structural view of Embodiments 3 and 4.
Figure 9:
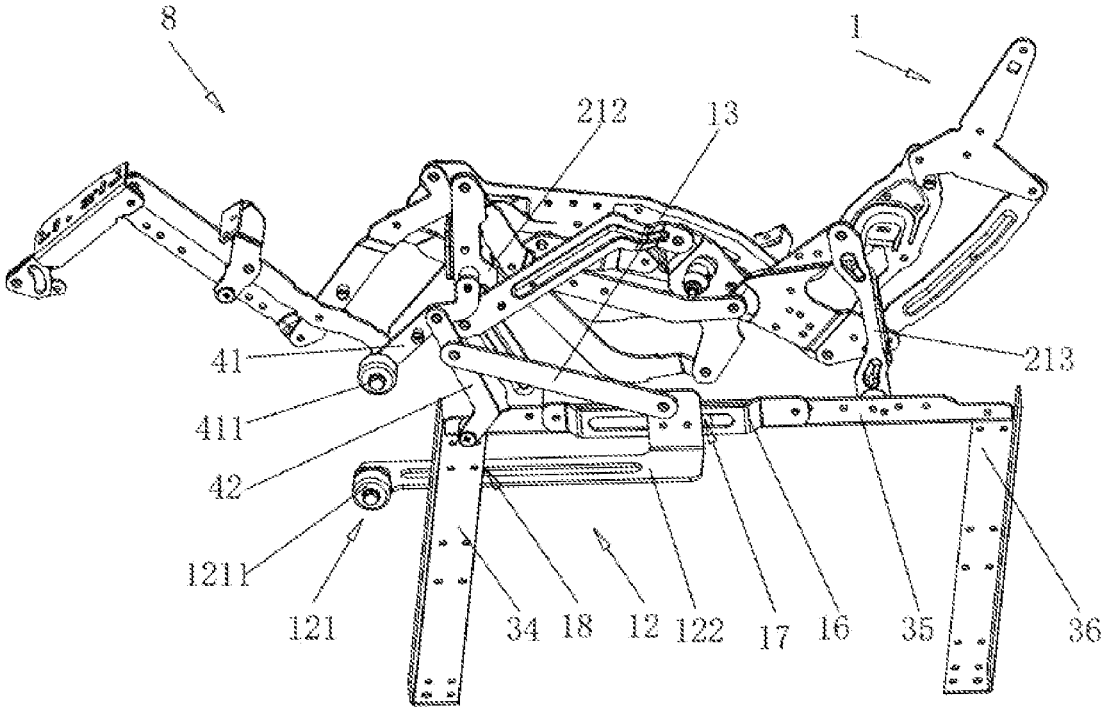
FIG. 9 is a structural view of Embodiments 3 and 4 in which the sofa is in a TV watching state.

As shown in FIGS. 8 and 9, a sofa unfolding device capable of avoiding forward overturning is provided, differing from Embodiment 1 in that, a second support assembly 12 is further provided on a seat 3, which includes a support part 121 and a slide part 122. The support part 121 includes a support wheel 1211, which is kept in front of the seat 3 during use. The support part 121 is fixedly connected at a left end of the slide part 122, and a first slide block 17 is connected at a right end of the slide part 122. The seat 3 includes a front part 34, a side part 35, and a rear part 36. There are two groups of side parts 35, so that the front part 34, the rear part 36 and the two groups of side parts 35 form a quadrilateral frame. The slide part 122 is slidingly connected with the side part 35 and the front part 34, respectively.

A slide rail 16 is detachably fixed on the side part 35. In some embodiments, the slide rail 16 is fixed on the side part 35 via a screw. The first slide block 17 is slidingly connected on the slide rail 16, so that it can slide along the slide rail 16 horizontally, for example, toward or away from a front end of the seat 3. A second slide block 18 is provided on the front part 34 and configured to be in slide cooperation with the slide part 122. An oblong slot is defined in the slide part 122, and the second slide block 18 is configured to slide in the oblong slot. The slide part 122 is positioned below the front part 34.

In actual use, a foot pad will be provided under the seat 3, for example, for the purpose of reducing vibration while supporting the seat 3, thereby providing, between the front part 34 and the ground, a gap enough for the slide part 122 to slide and pass through.

Figure 10:
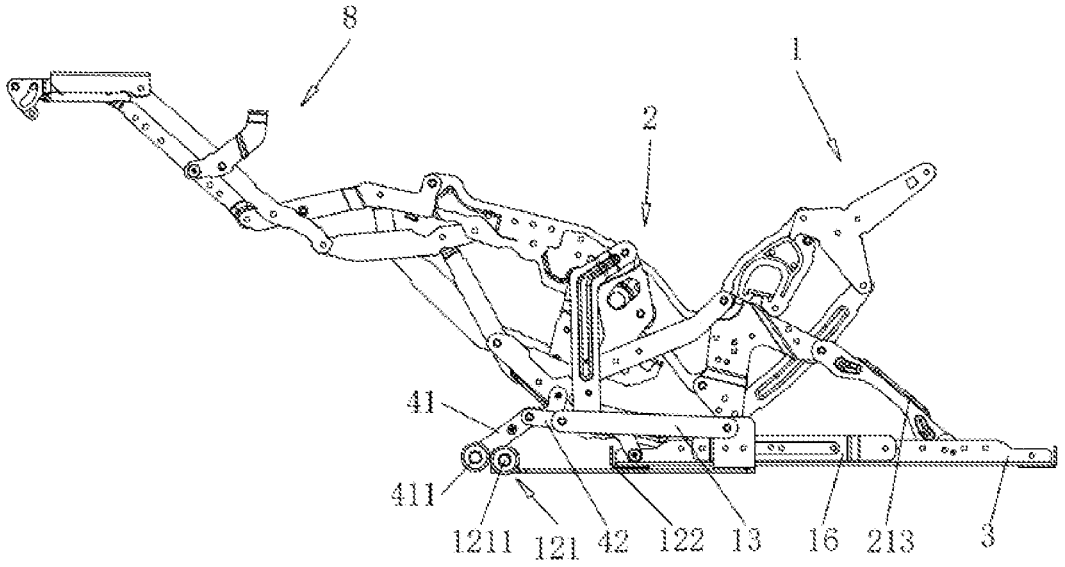
FIG. 10 is a structural view of Embodiments 3 and 4 in which the sofa is in a lying state.

As shown in FIGS. 9 and 10, a linkage member 13 is connected between the slide part 122 and the support assembly 42. In some embodiments, the linkage member 13 is a rod. One end of the linkage member is rotatably connected with the slide part 122 via a fifth pivot 14, and is rotatably connected with the support assembly 42 via a sixth pivot 15. When the support assembly 42 is stretched following the linkage assemble 2, the linkage member 13 is driven by the support assembly 42 to move the slide part 122 downward, which in turn drives the support wheel 1211 to roll to the left in front of the seat 3, so that the sofa can be supported by the second support assembly 12 during unfolding, and become more stable during use.

In some embodiments, a second support assembly 12 is slidingly provided at both of the two side parts 35, so that the sofa can be unfold more stably. During use, the support wheel 1211 can be continuously moved forward with the unfolding of the sofa, so as to provide an additional support for the sofa and endow an effect of avoid forward overturning with the sofa all the time. Meanwhile, the support wheel 1211 can push away a foreign object in front of the sofa during rolling, so as to avoid the occurrence of pressing the foreign object under the sofa, damaging the foreign object, or even overturning of the sofa due to the presence of the foreign object, there by improving the safety of the sofa during use. Furthermore, the distance that the support wheel 1211 can reach beyond the sofa is related to the degree that the sofa can be unfold, and thus the support wheel 1211 can be controlled within a range that the sofa can be unfold. This avoid a situation where the support wheel 1211 is stretched out of the sofa, thereby providing a more compact sofa structure.

Embodiment 4

As shown in FIGS. 8 and 9, a sofa unfolding device capable of avoiding forward overturning is provided, including a seat 3. A linkage assembly 2 is rotatably provided on the seat. A first end of the linkage assembly 2 is connected to a backrest assembly 1, and a second end of the linkage assembly 2 is connected to a leg rest assembly 8. In some embodiments, the backrest assembly 1 is located at the right of the seat 3, and the leg rest assembly 8 is located at the left of the seat 3. In use, a user faces a side where the leg rest assembly 8 is, a left side of the seat is called a front side, and a right side of the seat 3 is called a rear side. In actual use, the sofa can be switched between states by driving the linkage assembly 2, for example, from a sitting state (see, for example, FIG. 8) to a TV watching state (see, for example, FIG. 9), from the TV watching state to a lying state (see, for example, FIG. 10), or from a lying state back to the TV watching state or the sitting state.

In particular, the linkage assembly 2 includes a connecting rod assembly 211, a first follower 212, and a second follower 213. The first follower 212 is connected at a left side of the seat 3, and the second follower 213 is connected at a right side of the seat 3. The connecting rod assembly 211 is rotatably connected with the first follower 212 and the second follower 213, respectively. The connecting rod assembly 211 can be a plurality of connecting rod mechanisms. When the connecting rod assembly 211 is driven, it drives the first follower 212 and the second follower 213 to rotate to the left of the seat 3 in a counter-clockwise direction, while the leg rest assembly 8 is driven to be unfold gradually, so that the sofa can be switched from one state to another.

As shown in FIGS. 8 and 9, a support mechanism 4 is connected between the first follower 212 and the seat 3, and is configured to provide the sofa with a support during switching to the lying state, avoiding the occurrence of sofa overturning due to an excessive force applied upon the leg rest assembly 8. The support mechanism 4 includes an abutting member 41 and a support assembly 42. Both the abutting member 41 and the support assembly 42 are rods. A rolling wheel 411 is rotatably connected at a first end of the abutting member 41, and a second end of the abutting member 41 is rotatably connected with the first follower 212 via a first pivot 5, a first end of the support assembly 42 is rotatably connected with the abutting member 41 via a second pivot 6, and a second end of the support assembly 42 is rotatably connected with a third pivot. The abutting member 41 is unfolded, with the stretching of the linkage assembly 2, toward a front and a bottom of the seat 3 and finally abuts against the ground.

In particular, the seat 3, the first follower 212, the support assembly 42 and the abutting member 41 form a quadrilateral frame via hinging connection. Changing an orientation of any one of the four parts can drive the others to rotate since a sum of interior angles of the quadrilaterals frame remains unchanged. In this embodiment, the first follower 212 will tilt toward the front side of the seat 3 with the stretching of the connecting rod assembly 211, therefore, an orientation of the first follower 212 will be changed during unfolding of the sofa, which drives the support assembly 42 and the abutting member 41 to rotate, so that the abutting member 41 can drive the rolling wheel 411 to move toward the front and the bottom of the seat and finally abut against the ground. In some embodiments, with the rotation of the first follower 212, the abutting member 41 is rotated and stretched out in a clockwise direction, while moving downward gradually with the rotation of the first follower 212. Therefore, the rolling wheel 411 is moved forward and downward in a clockwise direction, so that it can exert a pushing force away from the sofa when being stretched out to push away a foreign object when the foreign object is in front of the sofa, and then abut against the ground to aid in supporting the sofa.

In particular, as shown in FIG. 8, when the sofa is a sitting state, the first follower 212 is in initial position, the support mechanism 4 is in a fold state, and the rolling wheel 411 is located above the seat 3. As shown in FIG. 10, when the sofa is in a lying state, the first follower 212 is rotated from a front of the sofa to a forefront of the sofa, the support mechanism 4 is fully stretched, the rolling wheel 411 touches the ground, being in front of the seat 3. In three states of the sofa, a fifth pivot 14 and a sixth pivot 15 are kept above the rolling wheel 411 all the time, while the first pivot 5 is above the second pivot 6.

As shown in FIGS. 8 and 9, a second support assembly 12 is further provided on a seat 3, which includes a support part 121 and a slide part 122. The support part 121 includes a support wheel 1211, which is kept in front of the seat 3 during use. The support part 121 is fixedly connected at a left end of the slide part 122, and a first slide block 17 is connected at a right end of the slide part 122. The seat 3 includes a front part 34, a side part 35, and a rear part 36. There are two groups of side parts 35, so that the front part 34, the rear part 36 and the two groups of side parts 35 form a quadrilateral frame. The slide part 122 is slidingly connected with the side part 35 and the front part 34, respectively.

As shown in FIGS. 9 and 10, a slide rail 16 is detachably fixed on the side part 35. In some embodiments, the slide rail 16 is fixed on the side part 35 via a screw. The first slide block 17 is slidingly connected on the slide rail 16, so that it can slide along the slide rail 16 horizontally, for example, toward or away from a front of the seat 3. A second slide block 18 is provided on the front part 34 and configured to be in slide cooperation with the slide part 122. An oblong slot is defined in the slide part 122, and the second slide block 18 is configured to slide in the oblong slot. The slide part 122 is positioned below the front part 34.

In actual use, a foot pad will be provided under the seat 3, for example, for the purpose of reducing vibration while supporting the seat 3, thereby providing, between the front part 34 and the ground, a gap enough for the slide part 122 to slide and pass through.

As shown in FIGS. 8 and 9, a linkage member 13 is connected between the slide part 122 and the support assembly 42. In some embodiments, the linkage member 13 is a rod. A first end of the linkage member is rotatably connected with the slide part 122 via a fifth pivot 14, and is rotatably connected with the support assembly 42 via a sixth pivot 15. When the support assembly 42 is stretched following the linkage assemble 2, the linkage member 13 is driven by the support assembly 42 to move the slide part 122 downward, which in turn drives the support wheel 1211 to roll to the left in front of the seat 3, so that the sofa can be supported by the second support assembly 12 during unfolding, and become more stable during use.

In some embodiments, a second support assembly 12 is slidingly provided at both of the two side parts 35, so that the sofa can be unfold more stably. During use, the support wheel 1211 can be continuously moved forward with the unfolding of the sofa, so as to provide an additional support for the sofa and endow an effect of avoid forward overturning with the sofa all the time. Meanwhile, the support wheel 1211 can push away a foreign object in front of the sofa during rolling, so as to avoid the occurrence of pressing the foreign object under the sofa, damaging the foreign object, or even overturning of the sofa due to the presence of the foreign object, improving the safety of the sofa during use. Furthermore, the distance that the support wheel 1211 can reach beyond the sofa is related to the degree that the sofa can be unfold, and thus the support wheel 1211 can be controlled within a range that the sofa can be unfold. This avoid a situation where the support wheel 1211 is stretched out of the sofa, thereby providing a more compact sofa structure.

As shown in FIGS. 9 and 10, in some embodiments, when the sofa is in a lying state, the support wheel 1211 will be located between the rolling wheel 411 and the front part34. When the sofa is switched between states, a length of the seat can be prolonged by the second support assembly 12, so as to prevent the seat 3 from overturning forward. When the sofa is unfolded to place, the support mechanism 4 provides a support to the linkage assembly 2, while providing an auxiliary support to the leg rest assembly 8 since it is located beside the leg rest assembly 8. In this way, the leg rest assembly 8 can bear a larger force without being damaged, avoiding the occurrence of deformation or damage of the leg rest assembly 8 when the user treads with a large force in a lying state or there is a large force exerted on the leg rest assembly 8, and increasing the safety and service life of the sofa during use.

Embodiment 5

Figure 11:
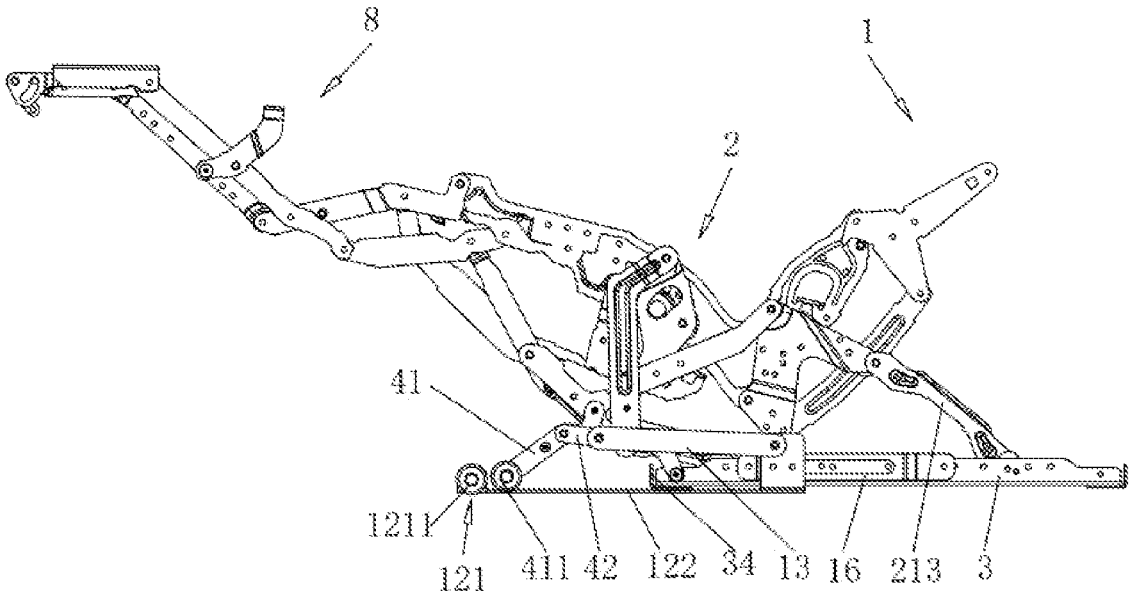
FIG. 11 is a structural view of Embodiment 5.

As shown in FIG. 11, a sofa unfolding device capable of avoiding forward overturning is provided, differing from Embodiment 4 in that, when the sofa is in a lying state, the rolling wheel 411 is located between the support wheel 1211 and the front part 34, and the support wheel 1211 serves a function of locking the rolling wheel 411. When the leg rest assembly 8 is pressed, the abutting member 41 provides the rolling wheel 411 with a tendency of rolling forward. However, due to the presence of the support wheel 1211 in front of the rolling wheel 411, if the rolling wheel 411 does have a tendency of rolling forward, the support wheel 1211 will block the rolling wheel 411 from moving forward, so that the support mechanism 4 is locked, rendering the sofa safer and more robust during use.

The above specific embodiments are merely provided for an explanation to the present application, rather than imposing a limitation thereto. Upon reading the specification, those skilled in the art may make modifications to the embodiment based on needs without paying any creative contribution, which, as long as falling within the scope defined by the claims of the present application, will be protected by the patent law.

LISTING OF REFERENCE SIGNS

1 backrest assembly
12 second support assembly
121 support part
1211 support wheel
122 slide part
13 linkage member
14 fifth pivot
15 sixth pivot
16 slide rail
17 first slide block
18 second slide block
2 linkage assembly
211 connecting rod assembly
212 first follower
213 second follower

3 seat
31 fixed member
32 first follower
34 front part
35 side part
36 rear part
4 support mechanism
41 abutting member
411 rolling wheel
42 support assembly
421 limiting rod
422 push rod
423 connecting rod
5 first pivot
6 second pivot
7 third pivot
8 leg rest assembly
9 linkage rod

What is claimed is:

1. A sofa unfolding device, comprising a backrest assembly, a linkage assembly, and a seat; wherein the linkage assembly is provided on the seat; the backrest assembly is rotatably connected with the linkage assembly; a support mechanism is provided at a front end of the linkage assembly; and the support mechanism is configured to stretch simultaneously forward and downward with unfolding of the linkage assembly and abut against a ground to act as a support structure, the support mechanism comprises an abutting member and a support assembly; the abutting member is rotatably connected with the linkage assembly via a first pivot; the support assembly is rotatably connected with the abutting member via a second pivot; and the support assembly is rotatably connected with the seat via a third pivot; and the abutting member is configured to stretch simultaneously forward and downward with the unfolding of the linkage assembly and abut against the ground, and a second support assembly is provided on the seat and configured to slide back and forth along the seat from a rear end of the seat to a front end of the seat, a linkage member is rotatably connected on the second support assembly via a fifth pivot and is rotatably connected with the support assembly via a sixth pivot, the second support assembly is configured to be driven by the linkage member to slide forward when the linkage assembly is unfolded, and the second support assembly comprises a support part located at the front end of the seat.

2. The sofa unfolding device according to claim 1, wherein a bottom of the abutting member is at a first position when the linkage assembly is in a folded state; the abutting member is at a second position when the linkage assembly is in an unfolded state; and a horizontal distance between the first position and the second position is greater than 100 mm.

3. The sofa unfolding device according to claim 1, wherein the abutting member is rotatably connected at a top of the abutting member with the linkage assembly via the first pivot; a bottom of the abutting member is configured to be a free end and connected with a roller; the roller is configured to be located above the seat when the linkage assembly is folded and located in front of the seat when the linkage assembly is unfolded; the support assembly comprises a support rod body; the support rod body is rotatably connected at a first end of the support rod body with the abutting member via the second pivot; and the support rod body is rotatably connected at a second end of the support rod body with the seat via the third pivot.

4. The sofa unfolding device according to claim 1, wherein the first pivot is configured to be kept above the second pivot.

5. The sofa unfolding device according to claim 1, further comprising a leg rest assembly, wherein the leg rest assembly is connected with the linkage assembly and configured to be unfolded with the unfolding of the linkage assembly; the leg rest assembly is configured to be located above the abutting member of the support mechanism when the linkage assembly is unfolded, a linkage rod is provided between the leg rest assembly and the linkage assembly; the seat comprises a fixed member and a first follower and a second follower provided at both ends of the fixed member, respectively; the first follower and the second follower are rotatably connected with the linkage assembly; the linkage rod is rotatably connected at a first end of the linkage rod with the first follower via a fourth pivot, and rotatably connected at a second end of the linkage rod with the linkage assembly; and both of the first pivot and the second pivot are kept above the fourth pivot.

6. The sofa unfolding device according to claim 5, wherein the support assembly comprises a limiting rod, a push rod, and a connecting rod; the push rod is rotatably connected at a first end of the push rod with the first follower, and the push rod is rotatably connected at a second end of the push rod with a first end of the connecting rod; the connecting rod is rotatably connected at a second end of the connecting rod with the abutting member via the second pivot; and the limiting rod is rotatably connected at a first end of the limiting rod with the fixed member via the third pivot, the limiting rod is rotatably connected at a second end of the limiting rod with the push rod, and a connection pivot between the limiting rod and the push rod is located between the first end of the push rod and the second end of the push rod.

7. The sofa unfolding device according to claim 1, wherein the seat comprises a front part and a side part connected with each other, the second support assembly further comprises a slide part connected with the support part, and the slide part is slidingly connected with the front part and the side part, respectively.

8. The sofa unfolding device according to claim 7, wherein a slide rail is connected on the side part, a first slide block in cooperation with the slide rail is provided on the slide part, and a second slide block in slide cooperation with the slide part is provided on the front part.

9. The sofa unfolding device according to claim 7, wherein a slide joint between the front part and the slide part is located above the slide part.

10. The sofa unfolding device according to claim 1, wherein the support part comprises a support wheel.

11. A sofa unfolding device, comprising a seat, a backrest assembly, a linkage assembly, and a leg rest assembly, wherein the linkage assembly is rotatably connected on the seat, the backrest assembly is rotatably connected to a rear end of the seat via the linkage assembly, the leg rest assembly is rotatably connected to a front end of the seat via the linkage assembly, a support mechanism is connected on the front end of the seat and comprises an abutting member and a support member, the abutting member is rotatably connected with the linkage assembly via a first pivot, the support member is rotatably connected with the abutting member via a second pivot and is rotatably connected with the seat via a third pivot, and the abutting member is configured to stretch simultaneously toward a front and a bottom of the seat with unfolding of the linkage assembly and abut against a ground.

12. The sofa unfolding device according to claim 11, wherein the linkage assembly comprises a connecting rod assembly, a first follower and a second follower, the first follower is rotatably connected to the front end of the seat, the second follower is rotatably connected to the rear end of the seat, the connecting rod assembly is rotatably connected with the first follower and the second follower, respectively, the backrest assembly and the leg rest assembly are rotatably connected with the connecting rod assembly, the first follower is configured to be rotated toward the front end of the seat with unfolding of the connecting rod assembly, the abutting member is rotatably connected with the first follower via the first pivot, and the abutting member is configured to stretch simultaneously toward the front and the bottom of the seat with a rotation of the first follower and abut against the ground.

13. The sofa unfolding device according to claim 11, wherein the abutting member is provided with a rolling wheel configured to abut against the ground, the rolling wheel is configured to be located above the seat when the linkage assembly is folded, and to be located in front of the seat when the linkage assembly is unfolded, and a fifth pivot and a sixth pivot are kept above the rolling wheel.

14. The sofa unfolding device according to claim 11, wherein the first pivot is located above the second pivot.

15. The sofa unfolding device according to claim 11, wherein a second support assembly is provided on the seat and configured to slide back and forth along the seat from the rear end of the seat to the front end of the seat, a linkage member is rotatably connected on the second support assembly via a fifth pivot and is rotatably connected with a support assembly via a sixth pivot, the second support assembly is configured to be driven by the linkage member to slide forward when the linkage assembly is unfolded, and the second support assembly comprises a support part located at the front end of the seat.

16. The sofa unfolding device according to claim 15, wherein the seat comprises a front part and a side part connected with each other, the second support assembly further comprises a slide part connected with the support part, and the slide part is slidingly connected with the front part and the side part, respectively.

17. The sofa unfolding device according to claim 16, wherein a slide rail is connected on the side part, a first slide block in cooperation with the slide rail is provided on the slide part, and a second slide block in slide cooperation with the slide part is provided on the front part.

18. The sofa unfolding device according to claim 16, wherein a slide joint between the front part and the slide part is located above the slide part.

19. The sofa unfolding device according to claim 15, wherein the support part comprises a support wheel.

* * * * *